United States Patent [19]

Chiang

[11] Patent Number: 5,002,073

[45] Date of Patent: Mar. 26, 1991

[54] WRITING APPARATUS WITH CIGARETTE ASH-FIRE EXTINGUISHER MECHANISM

[76] Inventor: Wu-Hsiung Chiang, No. 4, Lane 568, Sec. 2, Chung Shan Road, Chung Ho City, Taiwan

[21] Appl. No.: 509,794

[22] Filed: Apr. 17, 1990

[51] Int. Cl.[5] ..... A24F 13/18

[52] U.S. Cl. ..... 131/178; 131/256; 131/325.1; 401/195

[58] Field of Search ..... 131/237, 231, 256, 178, 131/235.1; 401/195

[56] References Cited

U.S. PATENT DOCUMENTS

| | | | |
|---|---|---|---|
| 1,863,000 | 6/1932 | Barnes | 131/256 |
| 2,335,674 | 11/1943 | Horlick | 131/256 X |
| 2,715,961 | 8/1955 | Field | 131/256 X |
| 4,353,379 | 10/1982 | Catellanos | 131/231 |
| 4,660,575 | 4/1987 | Andreason | 131/256 |
| 4,682,611 | 7/1987 | Rong | 131/256 |
| 4,809,715 | 3/1989 | Musetti | 131/237 |

FOREIGN PATENT DOCUMENTS

| | | | |
|---|---|---|---|
| 836584 | 4/1952 | Fed. Rep. of Germany | 131/256 |

*Primary Examiner*—Richard J. Johnson

*Attorney, Agent, or Firm*—Fleit, Jacobson, Cohn, Price, Holman & Stern

[57] ABSTRACT

A writing instrument is in the form of a tubular body divided into a front compartment and a rear compartment. The front compartment has a leading end socket for receipt of a writing element such as a ball point pen and the rear compartment can be used to extinguish cigarettes. To this end, the rear compartment is provided with a sliding bushing for receipt of a cigarette to be extinguished and the compartment has a base against which the cigarette may be extinguished. The bushing has a depressible button which can be used for gripping the cigarette when it is to be removed.

3 Claims, 3 Drawing Sheets

WRITING APPARATUS WITH CIGARETTE ASH-FIRE EXTINGUISHER MECHANISM

BACKGROUND OF THE INVENTION

The present invention is related to writing apparatus and more particularly to a writing apparatus combined with a cigarrete extinguisher mechanism for extinguishing a cigarrete.

Regular writing apparatus are generally specifically made for writing purpose and designed in a manner convenient for clamping on one's pocket. It is an idea of the present inventor to combine an ash tray with a writing apparatus so that the ash-fire of a cigarette can be conveniently extinguished when it is inserted in such a writring apparatus.

It is therefore, an object of the present invention to provide a writing apparatus which has a combined cigarette extinguisher mechanism.

Another object of the present invention is to provide a writing apparatus combined with a cigarette extinguisher mechanism which is inexpensive to manufacture and easy to assemble.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
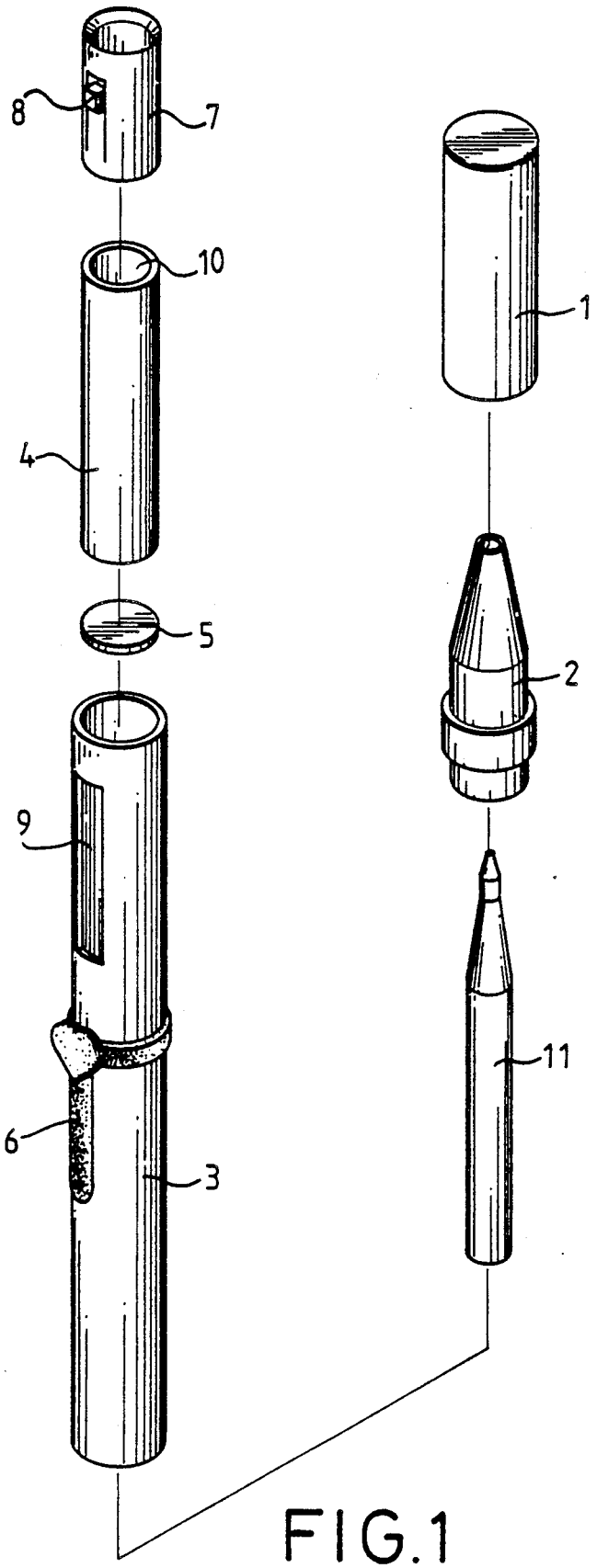
FIG. 1 is a perspective fragmentary view of the present invention.
Figure 2:
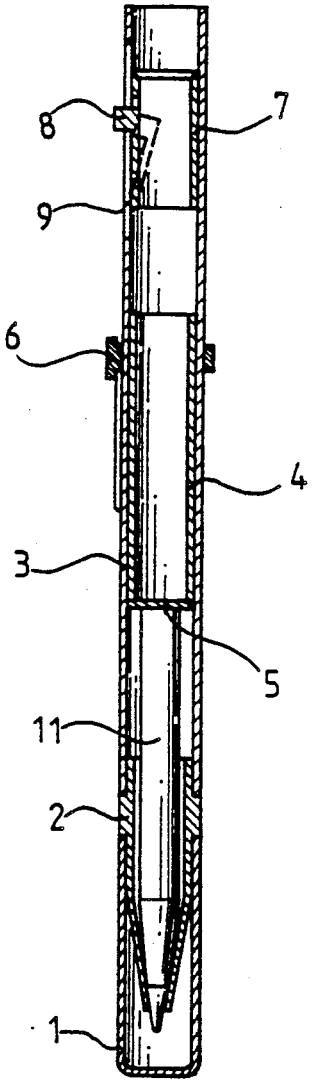
FIG. 2 is a sectional assembly view thereof.

Referring to FIGS. 1 and 2, a ball-point pen 3 in accordance with the present invention comprises a cylindrical penholder 3 having an elongated slot 9 in its outer wall and a metal plate 5 fixedly set therein to divide its bore into a front chamber and a rear chamber. A metal inner tube 4 is received in the rear chamber. A replaceable writing element 11 and a front socket 2 are fastened in the front chamber with the top end of the writing element engaged against the metal plate 5 and with the writing tip of the element 11 protruding beyond the penholder and the front socket 2 for writing. A cap 1 is mounted on the penholder 3 to cover the element 11 and the front socket 2 inside the front chamber of the penholder 3. A cylindrical slider member 7 which includes a unitary, substantially L-shaped spring catch button 8 is inserted in the rear chamber of the penholder 3 with the catch button 8 projecting out of the penholder 3 through the elongated slot 9. Therefore, the slider member 7 is permitted to slide inside the penholder 3 within the length of elongated slot 9. The cylindrical slider member 7 has a bore slightly larger than the outer diameter of a regular cigarette and the front end of which is chamfered for inserting a cigarette. A pocket clip 6 is mounted on the penholder 3 below the elongated slot 9 for hanging the pen on a pocket.

Figure 3:
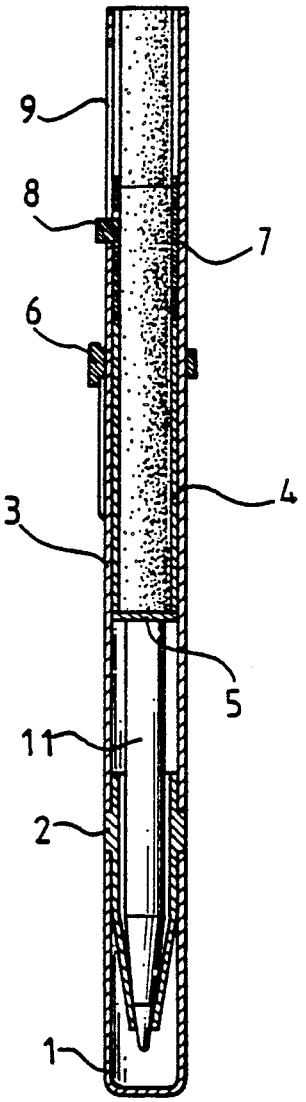
FIG. 3 is a schematic drawing of the present invention, in which a cigarrete is inserted in the penholder thereof.
Figure 4:
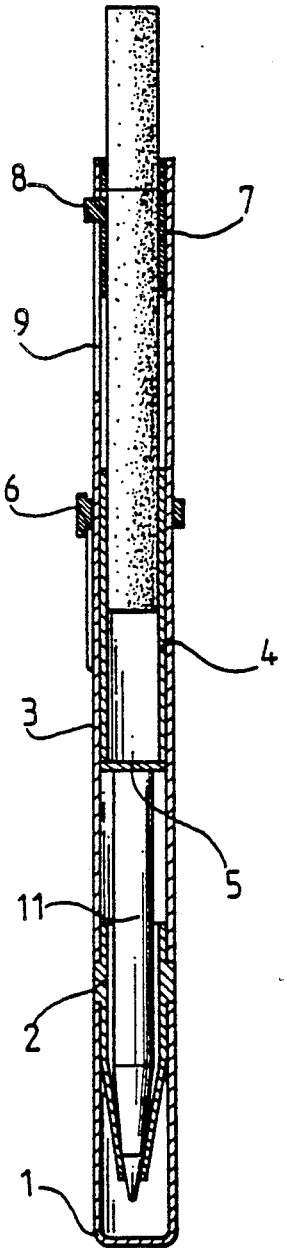
FIG. 4 is a schematic drawing of the present invention, illustrating an operation to remove a cigarette from the penholder thereof.

When in use, a burning cigarrete can be extinguished by inserting it from the rear end opening 10 of the penholder 3 through the slider member 7 into the metal inner tube 4 with its burning end stopped against the metal plate 5 (see FIG. 3). Because of the design of the metal inner tube 4 and the metal plate 5, the penholder 3 is protected from burning during cigarette ash-fire extinguishing operation. After the cigarette is extinguished, the catch button 8 is pressed down to firmly retain such a cigarette in the slider member 7 and the slider member 7 is then pushed outward to carry such a cigarette out of the penholder 3 (see FIG. 4).

According to the present invention, the spring catch button 8 is integrally made on the slider member 7 to form an unitary piece so that manufacturing cost is greatly reduced. After the catch button 8 is pressed downward, the slider member 7 can be conveniently inserted into penholder 3. As soon as the slider member 7 is inserted inside the penholder 3 permitting the springing catch button 8 to project out of the penholder 3 through the elongated slot 9, it becomes firmly retained inside the penholder 3.

I claim:

1. A writing instrument combined with a cigarette extinguisher mechanism comprising a tubular body, an internal wall in said body dividing same into an elongate front compartment and elongate rear compartment, said front compartment having a socket associated therewith at one end which is remote from the rear compartment for securing a writing element in the front compartment, said rear compartment having a peripheral wall with an elongated slot, a longitudinally moving bushing received in the rear compartment for receipt of a cigarette to be extinguished, said bushing having an inner diameter no less than the diameter of the cigarette, and a control button on said bushing projecting through said elongate slot to confine movement of the bushing along the rear compartment to the length of the slot.

2. The instrument of claim 1 wherein the control button is integral with said bushing and is resiliently depressible for gripping the cigarette.

3. The instrument of claim 1 including an inner liner tube in the rear compartment between the bushing and said internal wall.

* * * * *